US005301825A

United States Patent [19]

Di Scala et al.

[11] Patent Number: 5,301,825

[45] Date of Patent: Apr. 12, 1994

[54] AIR REMOVAL DEVICE FOR USE WITH A NURSING BOTTLE

[76] Inventors: Luciano Di Scala, 111 Arpage Dr. East, Shirley, N.Y. 11967; Frank Ida, 1 Jillet Dr., Smithtown, N.Y. 11787

[21] Appl. No.: 920,866

[22] Filed: Jul. 28, 1992

[51] Int. Cl.[5] ..... A61J 9/00; A61J 9/06

[52] U.S. Cl. ..... 215/11.1; 215/11.3; 215/11.6

[58] Field of Search ..... 215/11.1-11.6, 215/100 R

[56] References Cited

U.S. PATENT DOCUMENTS

| | | | |
|---|---|---|---|
| 2,469,489 | 5/1949 | Allen et al. | 215/11.1 |
| 2,550,210 | 4/1951 | Vance, Jr. | 215/11.1 X |
| 3,162,318 | 12/1964 | Woodbury, Jr. | 215/11.1 |
| 3,232,467 | 2/1966 | Barton | 215/11.1 X |
| 3,648,873 | 3/1972 | Grobbel | 215/11.3 |
| 3,718,140 | 2/1973 | Yamauchi | 215/11.1 |
| 3,955,698 | 5/1976 | Hammer | 215/11.3 |
| 3,998,348 | 12/1976 | Sammaritano | 215/11.3 |
| 4,796,767 | 1/1989 | McKeown | 215/11.1 |
| 4,880,125 | 11/1989 | LeBeau | 215/11.3 |
| 4,979,629 | 12/1990 | Askerneese | 215/11.1 |

FOREIGN PATENT DOCUMENTS

| | | | |
|---|---|---|---|
| 9460 | 4/1980 | European Pat. Off. | 215/11.1 |

*Primary Examiner*—Sue A. Weaver

[57] ABSTRACT

An air removal device for use with a flexible liner baby nursing bottle, having slots in the shell body that extend along the sides of the shell body, a disc inside the shell body with tabs that extend through the shell body, and a ring on the outside of the shell body that connects to the disc's tabs such that the movement of the ring/disc combination exerts pressure on the flexible liner and expels the air from the flexible liner.

6 Claims, 3 Drawing Sheets

AIR REMOVAL DEVICE FOR USE WITH A NURSING BOTTLE

FIELD OF THE INVENTION

Our invention relates to an air removal device for use with nursing bottles, more particularly, to shell type nursing bottles utilizing flexible liners.

BACKGROUND OF THE INVENTION

The present invention is a device for expelling air out of a flexible liner baby nursing bottle, the general type, having an open end shell body. A common problem with baby bottles is air in the bottle which can be ingested by the baby during feeding, and this can be the cause of gastric disturbances. It was believed that the introduction of plastic bag lined baby bottles would eliminate air problems. As the baby sucked down fluid the bag would collapse. This is true, however when the bottle is placed at rest, the weight of the remaining fluid causes the bag to sag and draw air into the bag. The most common method of removing air prior to administering it to the baby was to push on the plastic liner either with a long narrow object or your fingers. Some inventors came up with inventions that try to make this process more convenient:

| U.S. Pat. No. | Inventor |
|---|---|
| 3,955,698 | Hammer |
| 3,998,348 | Sammaritano |
| 4,979,698 | Askerneese |

plus many more. They, however, fail to make their device mechaically and economically practical. Therefore it is the object of this invention to provide a device that is removes the air from the plastic bag, and a few other things, that is inexpensive and easy to use.

SUMMARY OF THE INVENTION

Accordingly, it is the object of this invention to provide for an air removal device that uses flexible plastic liners/bags in general type open end shell body baby nursing bottles. This device is made using materials and processes same as those known to make the present bottles, but not limited to those materials and processes. One possible combination may be injection molding of poly-propolyene. The bottle and its components, the disc, and the ring of our invention would all be made separately then later assembled.

Our invention consists of:

A general type open end baby nursing bottle with 2 slots that are diametrically opposed to one another, and extend almost to either extreme of the shell body, but not all the way to the end. The distance from the ends has to be dependent upon the properties and strength of the material used to manufacture the shell body.

A disc that is conically shaped which fits inside the shell body of the bottle. It is made of a similar or the same material as the shell body, by a similar or the same process. The disc has 2 tabs, once again, diametrically opposed, protruding radially outward such that when the disc is inside the shell body, the tabs extend through the slots in the shell body. The open edge of the conic shape of the disc is tapered to very thin to permit flexibility of the material used.

A ring dimensioned to fit around the shell body, with notches that embrace the protruding tabs of the disc.

This ring is also manufactured similarly to that of the shell body and disc.

Due to the semi-elastical nature of the materials use, and the choice of material must keep this in consideration, all parts are assembled. More particularly, the disc is placed inside the shell body and the ring is placed over the tabs on the outside of the shell body. The ring and the disc are connected and they are slideable along the shell body. The tapered conical edge of the disc fits snugly inside the shell body and exerts a mild radially outward force on the shell body. This force, combined with friction of the materials, is what counter acts the force of gravity and holds the position of the disc and ring. The ring on the outside of the shell body permits the user to position the disc and ring to exert pressure on the flexible plastic liner/bag to expel whatever air may be in the flexible plastic liner/bag. An additional feature of the disc inside the shell body is the protection the disc offers from accidental puncture of the flexible plastic liner/bag. Also the length of the slots in the shell body tend to make the shell body flimsy, the ring, being continuous around the circumference of the shell body, strengthens, supports and, increases the overall rigidity of the device.

Figure 1:
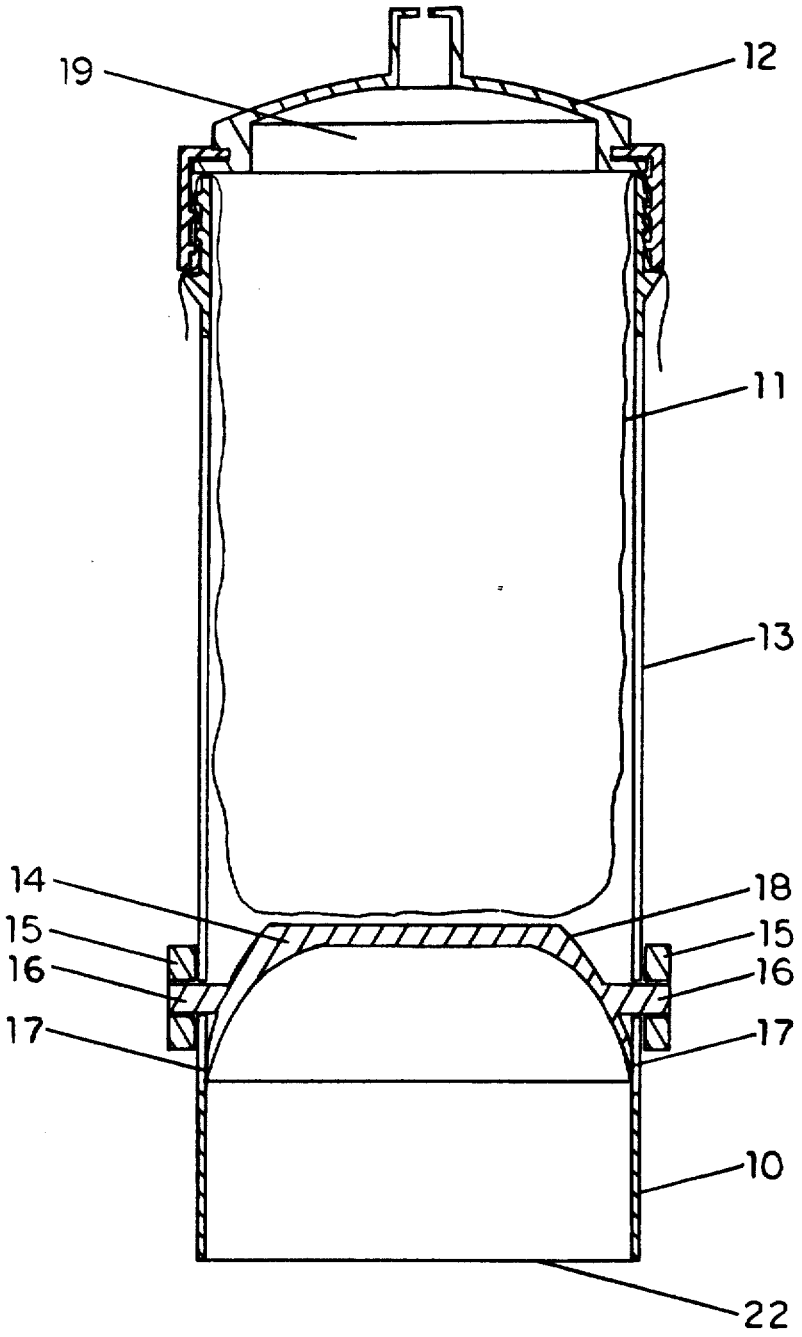
FIG. 1—a cross section of a flexible liner baby nursing bottle embodying the present invention FIG. 2—a top view of the disc portion of the present invention FIG. 3—a sectioned view of FIG. 2
Figure 2:
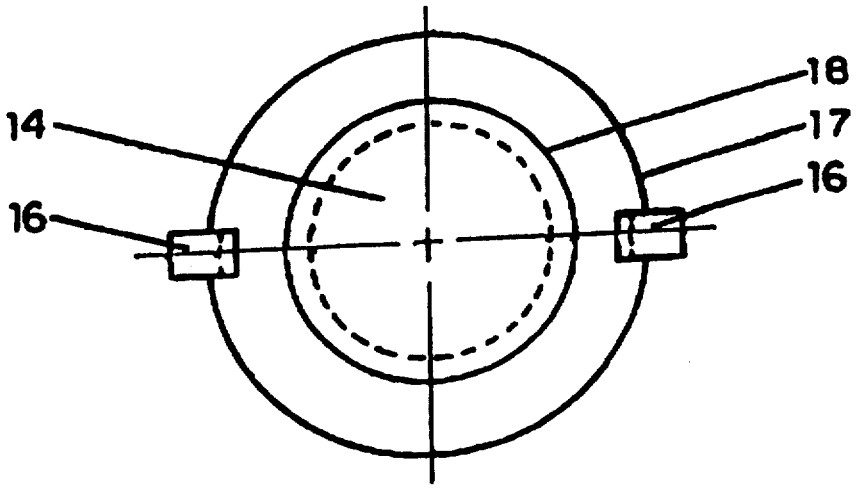
Figure 3:
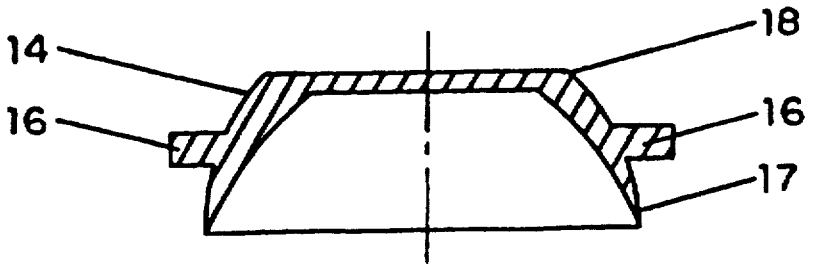
Figure 4:
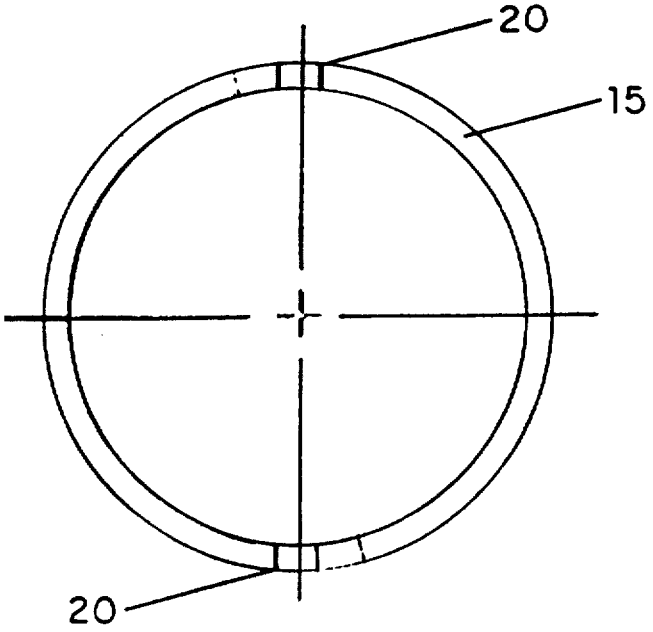
FIG. 4—a top view of the ring portion of the present invention
Figure 5:
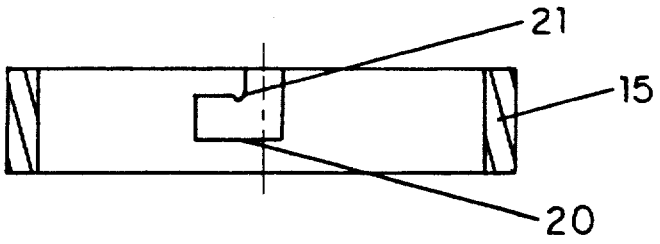
FIG. 5—a sectioned view of FIG. 4

10—a flexible liner baby nursing bottle
11—a flexible plastic liner/bag
12—the nipple
13—an elongated slot along the side of the nursing bottle
14—the disc portion of the present invention
15—the ring portion of the present invention
16—a tab of the disc portion of the present invention
17—the flexible edge of the disc portion of the present invention
18—the cone of the disc portion of the present invention
19—the cavity of the nipple
20—the notch of the ring portion of the present invention
21—the retaining tab of the ring portion of the present invention
22—the open end of the bottle

DESCRIPTION OF THE PREFERRED EMBODIMENT

Flexible liner baby nursing bottle 10 has flexible liner 11 typically inserted in bottle 10. Nipple 12 is on one end of the bottle 10 and the open end of the bottle 22 is at the other end of the bottle 10. The disc 14 is inserted into the open end of the bottle 22 and the tab portion 16 extends through the elongated slots 13.

The ring portion 15 embraces the tab 16 of the disc 14 in notches 20. The ring 15 has retaining tabs 21 to embrace the tabs 16 of the disc 14. As the disc 14 slides toward the nipple 19 to maximize the compression of the flexible liner 11.

The disc 14 has flexible edge 17 that applies pressure to the wall of the bottle 10 to maintain it's position against the force of gravity, as to not allow air to be drawn back into the liner. It also serves to seal off the open end 22 of the bottle 10.

We claim:

1. An air removal device for use in combination with a nursing bottle including an outer rigid tubular shell open at both ends and having a longitudinal axis and longitudinal slots extending axially along the length of the shell, a flexible liner closed at one end and open at its opposite end, means of securing the open end of the liner at one of the open ends of the shell such that the liner extends down into the shell, a nipple in fluid communication with the open end of the liner, means of securing the nipple to said shell at said liner open end, and ah air removal device for removing excess air from the liner including a disc dimensioned for sliding engagement along the interior of the shell, said disc having radially extending tabs dimensioned to extend through said longitudinal slots in said shell, a ring dimensioned to slide longitudinally along the exterior of the shell and means connecting the tabs of the disc with the ring on the exterior of the shell such that when pressure is applied to the ring to slide said ring along the exterior of the shell the disc inside the shell contacts the closed end of the flexible liner to exert pressure on the liner, thereby expelling any excess air from the liner.

2. The device of claim 1 wherein said disc inside the shell of the bottle includes a top surface that is contoured similar to the shape of the inside of the nipple to maximize the upper travel range of the disc.

3. The device of claim 1 wherein said disc inside the shell of the bottle includes a tapered flexible lower edge that is dimensioned apply pressure orthagonally outward with the body of the bottle thereby enabling the disc to maintain its position along the shell of the bottle.

4. The device of claim 1 where the disc inside the shell of the bottle is dimensioned to protect the flexible liner from accidental puncture from said open end opposite said nipple.

5. The ring as claimed in claim 1 where the connecting means includes notches in said ring dimensioned to embrace said tabs that protrude through the shell of the bottle and are connected to the disc inside the bottle.

6. The device of claim 1 where the ring is continuous around the circumference of the shell so as to permit added rigidity to the bottle.

* * * * *